US007055446B2

(12) United States Patent
Cobb et al.

(10) Patent No.: US 7,055,446 B2
(45) Date of Patent: Jun. 6, 2006

(54) HIGH-FROUDE HULL SHIP

(75) Inventors: Bruce W. Cobb, Fremont, CA (US); Terrence W. Schmidt, Santa Clara, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/712,986

(22) Filed: Nov. 12, 2003

(65) Prior Publication Data

US 2004/0159272 A1 Aug. 19, 2004

Related U.S. Application Data

(60) Provisional application No. 60/426,070, filed on Nov. 12, 2002.

(51) Int. Cl.
*B63B 1/00* (2006.01)

(52) U.S. Cl. ..... 114/61.2; 114/61.26

(58) Field of Classification Search ..... 114/61.1, 114/61.12, 61.14, 61.2, 61.26, 162
See application file for complete search history.

(56) References Cited

U.S. PATENT DOCUMENTS

| | | | | |
|---|---|---|---|---|
| 3,304,899 | A * | 2/1967 | Weatherly | 114/39.25 |
| 5,134,950 | A * | 8/1992 | Berte | 114/39.27 |
| 5,320,056 | A * | 6/1994 | Marinzoli | 114/74 R |
| 5,592,895 | A * | 1/1997 | Schmidt | 114/274 |
| 5,787,828 | A * | 8/1998 | Barbier et al. | 114/61.1 |
| 5,794,558 | A * | 8/1998 | Loui | 114/274 |
| 6,487,982 | B1 * | 12/2002 | Takahashi et al. | 114/121 |
| 6,666,160 | B1 * | 12/2003 | Orneblad | 114/291 |

* cited by examiner

*Primary Examiner*—Stephen Avila
(74) *Attorney, Agent, or Firm*—Mark A. Wurm; Graybeal Jackson Haley LLP

(57) ABSTRACT

A large-waterplane-area ship operable to efficiently operate at a high-Froude velocity. In one embodiment of the invention, a large-waterplane-area ship includes a hull structure having a plurality of exclusive hull portions protruding from a main body of the hull structure. Each hull portion has a length shorter than the length of the main body and each hull portion has a buoyancy wherein the combined buoyancy of each hull portion is sufficient to support the main body above a waterline. As such, each hull portion acts independently and exclusively of other hull portions with respect to the effects of wave drag. Therefore, the ship overcomes wave drag at lower velocities.

11 Claims, 5 Drawing Sheets

HIGH-FROUDE HULL SHIP

CLAIM OF PRIORITY

This application claims priority from U.S. Provisional Application Ser. No. 60/426,070, which was filed on Nov. 12, 2002, which is incorporated by reference.

BACKGROUND OF THE INVENTION

The shape of a typical ship's hull is designed to minimize the drag of the water on the ship such that it travels on the surface of the water as efficiently as possible. This can be seen in the vast majority of large-waterplane-area ship's today in their long and sleek look. A large-waterplane-area ship, which garners the majority of its buoyancy from the amount of surface area of the hull that meets the plane of water, can be distinguished from a small waterplane area ship, which garners the majority of its buoyancy from underwater displacement pontoons. The long and narrow hull of a large-waterplane-area ship minimizes the effects of the water on the acceleration and velocity of the ship. As a general rule, the longer the length of the hull is with respect to its width, the more efficient the vessel operates.

Several physical factors affect the operation of both small and large-waterplane-area ships. For example, strong headwinds or other wind resistance will affect the velocity and acceleration of a ship. In another example, the friction of the water against the ship constantly works against the velocity of the ship. Another physical factor, discussed in greater depth below, is the wave drag of a ship. That is, the effect of the ship's own wake working against its velocity.

It is well known in the art that a Froude number may be used to mathematically express the efficiency of the ship's hull design with respect to wave drag. The ship's Froude number is defined as follows:

F=v/sqrt(g*l), v=velocity, g=acceleration of gravity, and

I=length of hull.

The effect of wave drag on a ship's velocity is described in Modern Ship Design, by Thomas C. Gillmer, 1970 which states, "The practical limiting speed for displacement surface vessels is basically that of wavelength to ship length, where one wavelength, created by the ship, is equal to the ship's waterline length." For efficient operation from the standpoint of powering and fuel consumption, typical ships have a velocity limit corresponding to a Froude number of 0.4. When a ship attempts to exceed this velocity limit, the drag of the water increases exponentially and the resulting power required to overcome the additional drag leads to extreme inefficiency. As a result, a ship is not typically designed with such propulsion requirements in mind.

FIG. 1 is a graph of a typical ship's wave drag (Cw) versus its Froude number. As can be seen, at low Froude numbers the wave drag is relatively low, proportionally increasing as the Froude number increases. An increase in the Froude number represents an increase in the velocity of the ship which corresponds to an increase in wave drag Cw. However, when the ship's velocity reaches the point corresponding to a Froude number of 0.4, the wave drag Cw increases exponentially with respect to an increase in the ship's velocity. This increase in wave drag Cw is well established in the prior art for all surface displacement ships and is often referred to as the resistance or powering "hump" 100. A hull experiences peak wave drag Cw in the center of the hump 100, which corresponds to a Froude number of 0.5.

Because of the high wave drag Cw, operation in the hump 100 region requires high propulsion power which leads to inefficient fuel usage. A ship that requires a constant operational velocity for a long time should not do so in the hump 100 region. As a result, the overall length of a ship's hull designed today is typically increased to allow the ship to reach greater velocities before the Froude number reaches 0.4. That is, most large-waterplane-area ships are designed to operate below the hump 100.

For example, FIG. 2 is a plan view of a conventional ship 200 having a relatively large overall hull length 205 as compared to its width W. The ship 200 is designed to operate at velocities corresponding to Froude numbers less than 0.4. If greater velocities are desired, one can design the ship's hull to be longer such that the 0.4 Froude number corresponds to a higher velocity than before. The alternative is to provide enough propulsion power to overcome the hump 100, such as with modern Destroyers or other high speed ships. Both solutions are inefficient because space is wasted by either increasing the length of the hull or the amount of propulsion power. As a result, it is difficult to efficiently gain velocity beyond a Froude number of 0.4 in large-waterplane-area ships.

It is also known in the art that operating a ship at a velocity having a corresponding Froude number greater than 0.8 substantially reduces wave drag Cw. Again referring to FIG. 1, one can see that the amount of wave drag Cw is substantially the same at a Froude number of 0.8 as it is for a Froude number of 0.4. That is, once the velocity of the ship overcomes the high wave drag Cw of the hump 100, additional increases in velocity do not require an exponential increase in propulsion power.

One such ship designed to operate at velocities corresponding to Froude numbers greater than 0.8 is disclosed in U.S. Pat. No. 5,592,895, entitled SMALL WATERPLANE AREA HIGH SPEED SHIP to Schmidt, which is assigned to the Lockheed Missiles and Space Co. and which is incorporated by reference. In this disclosure, Schmidt describes a small waterplane ship designed to operate at high speeds corresponding to Froude numbers greater than 0.8. Specifically, Schmidt disregards the convention of designing a hull to be as long as possible to attain greater velocities before the Froude number reaches 0.4 by disclosing a ship with a short hull wherein the hump 100 is overcome at fairly low velocities. The short hull, however, limits the size of the ship and the concept is not practicable for large-waterplane-area ships that require substantial payload capabilities.

Therefore, it is desirable to have a large-waterplane-area ship that reaches and surpasses the hump 100 at a low velocity such that the ship's operational velocity or cruising velocity is above the hump 100 at a high Froude number while also having a hull that provides substantial payload capacity.

SUMMARY OF THE INVENTION

An embodiment of the invention is directed to a large-waterplane-area ship operable to efficiently operate at a high-Froude velocity. In one embodiment, a large-waterplane-area ship includes a hull structure having a plurality of exclusive hull portions protruding from a main body of the hull structure. Each hull portion has a length shorter than the length of the main body and each hull portion has a buoyancy wherein the combined buoyancy of each hull portion is sufficient to support the main body above a waterline. As such, each hull portion acts independently and exclusively of other hull portions with respect to the effects of wave drag. Therefore, the ship overcomes the wave drag at lower velocities while also having a relatively long main body.

In another embodiment, a large-waterplane-area ship includes a plurality of struts protruding from a main body and a plurality of pontoons each coupled to at least one of the plurality of struts. The buoyancy of the pontoons can be adjusted such that the ship operates as a large-waterplane-area ship with multiple hull portions allowing velocities in the high-Froude area or adjusted such that the ship operates as a small waterplane-area ship with multiple submerged pontoons providing buoyancy while still allowing velocities in the high-Froude area.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings.

DETAILED DESCRIPTION

Figure 1:
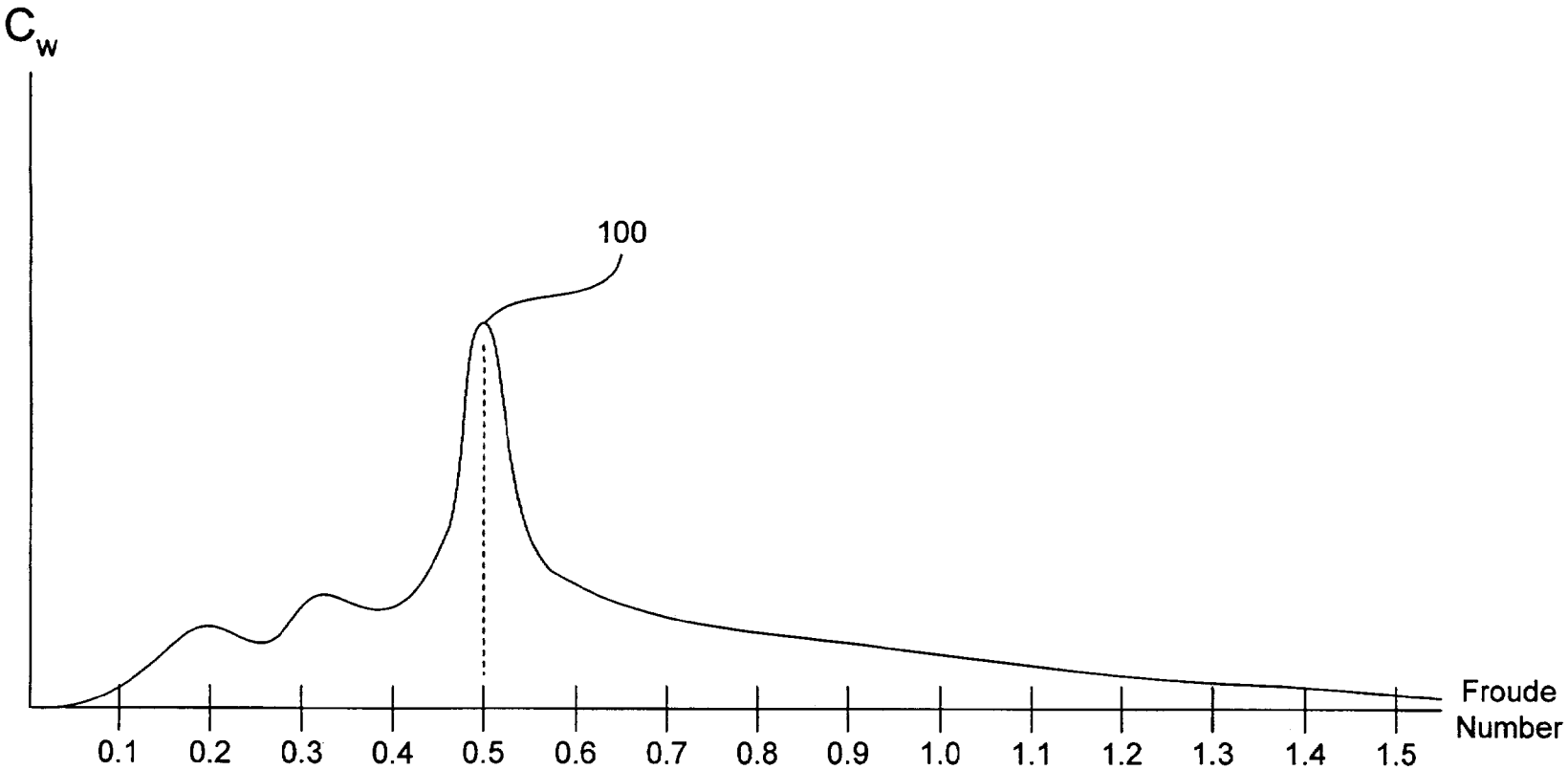
FIG. 1 (PRIOR ART)
FIG. 1 is a graph of a typical ship's wave drag (Cw) versus its Froude number.
Figure 2:
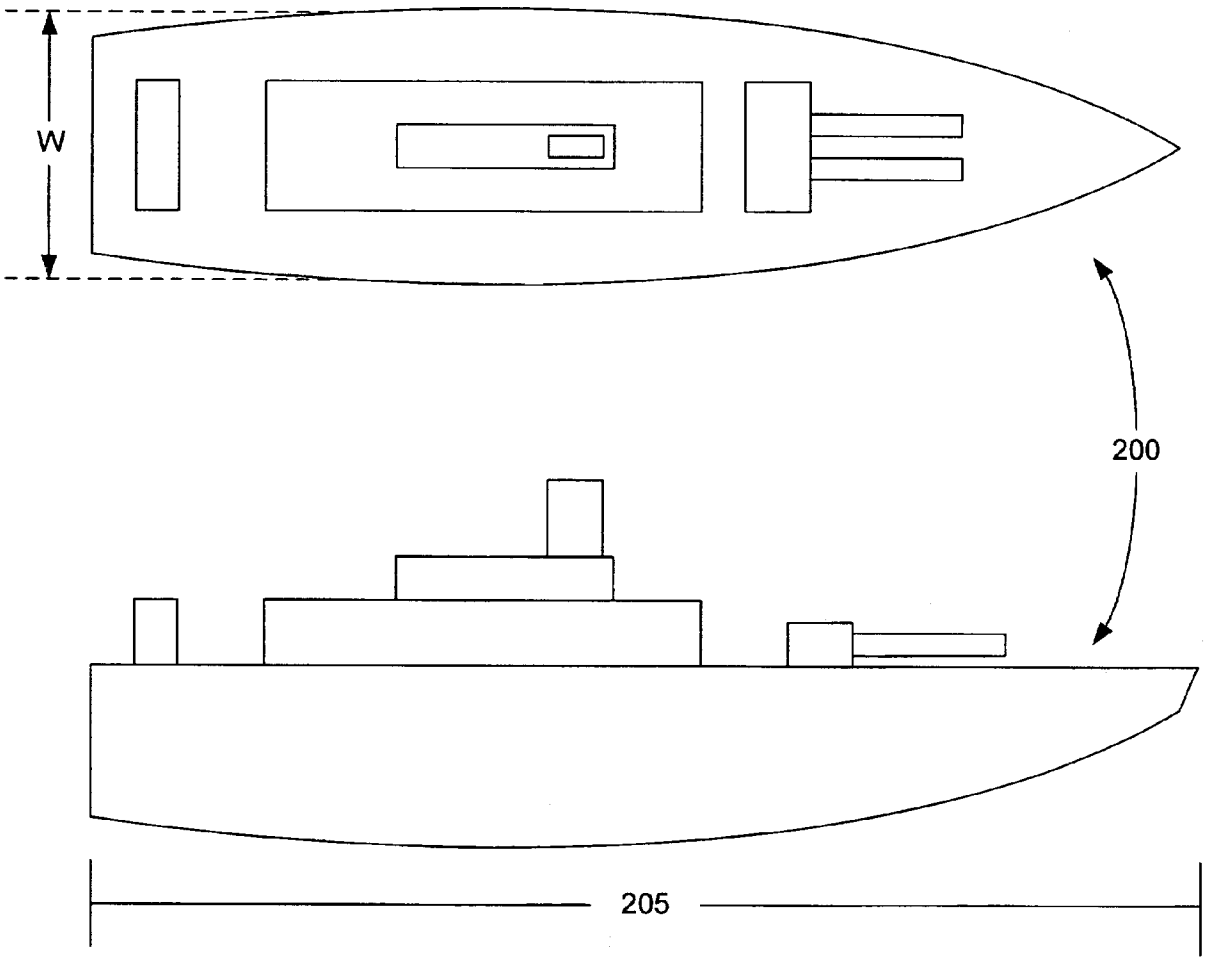
FIG. 2 (PRIOR ART)
FIG. 2 is a plan view of a conventional ship having a relatively large overall hull length as compared to its width.
Figure 3:
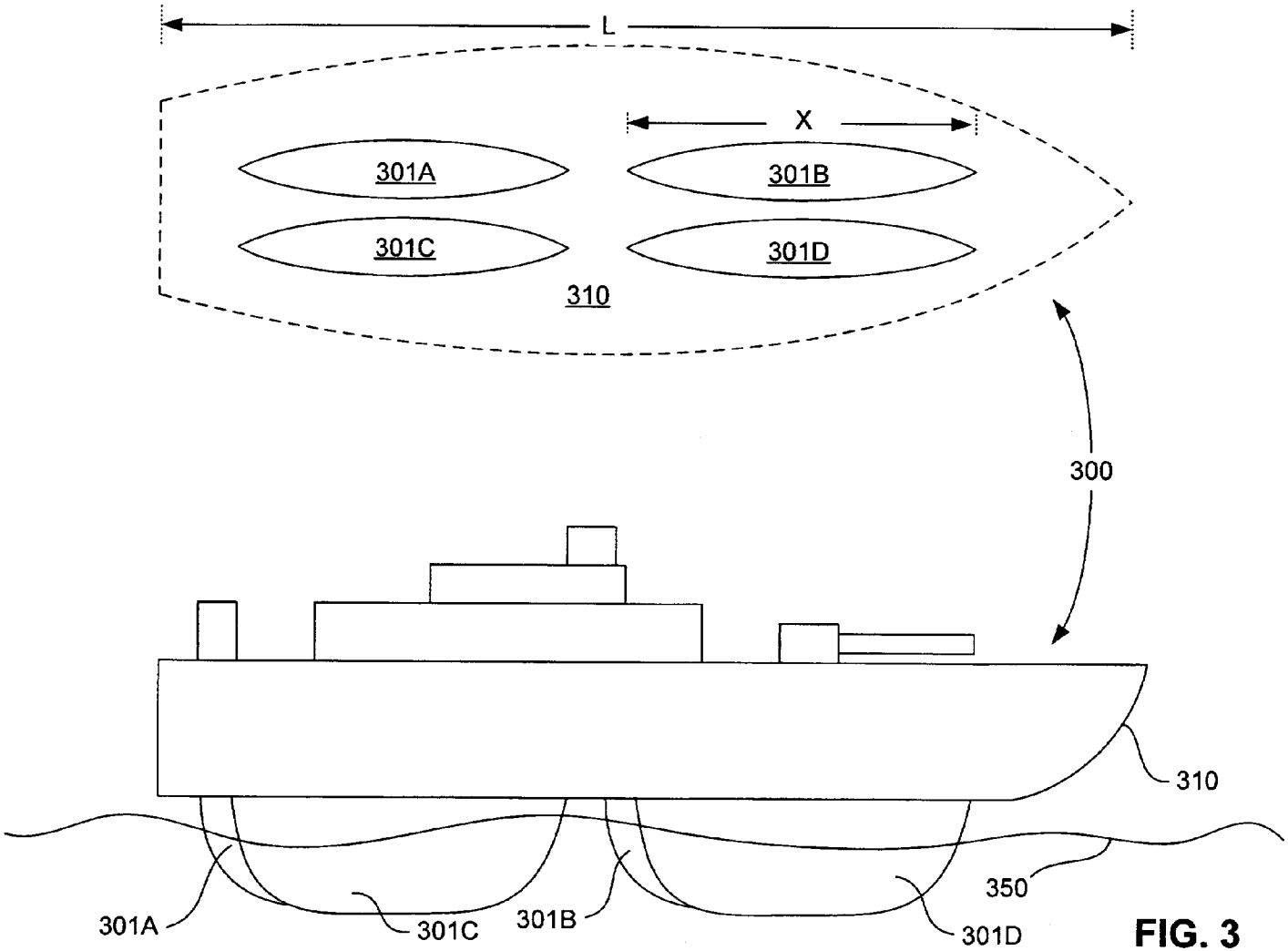
FIG. 3 is a plan view of a ship having a plurality of hull portions according to an embodiment of the invention.

FIG. 3 is a plan view of a ship 300 having a plurality of exclusive hull portions 301*a–d* according to an embodiment of the invention. In this embodiment, the ship 300 has four hull portions 301*a–d* that protrude from a main hull structure or frame 310. The hull portions 301*a–d* each have a length X, where X is less than a length L of the Frame 310 which provide a combined buoyancy that support the ship 300 in water. That is, each hull portion 301*a–d* has a buoyancy that when combined with the buoyancies of the other hull portions is enough to support the weight of the ship 300 above a waterline 350 such that the frame 310 does not engage the waterline 350. Since the Frame 310 does not engage the waterline 350, the frame does not add buoyancy to support to the ship 300.

Because the combined buoyancy of the hull portions 301*a–d* supports the ship 300 with its frame 310 above the waterline 350, the hull portions 301*a–d* are exclusive of one another with respect to determining wave drag as a function of velocity. Each hull portion 301*a–d* thus operates on its own exclusive Froude curve because each hull portion behaves as if it were its own hull with respect to the waterline 350. Therefore, when determining the performance characteristics of the ship 300, each hull portion 301*a–d* is analyzed individually.

For example, a typical conventional ship having a length of 100 meters reaches a velocity of approximately 24 knots before reaching the hump 100 in its respective Froude curve. To overcome the hump 100 and reach a velocity corresponding to a Froude number of 0.8 or greater, the ship must reach a velocity of 48 knots. Because the power required to attain a speed of 48 knots is substantial, most conventional ships are designed to cruise at a velocity below the hump 100. The more efficient operating velocity or cruising velocity for conventional large-waterplane-area ships is at Froude numbers below 0.4.

The ship 300 of FIG. 3, however, is analyzed differently because each hull portion 301*a–d* is exclusive and behaves independently of the other hull portions. For example, for a ship 300 with hull portions 301*a–d* having lengths of 20 meters and having a frame 310 with an overall length of 100 meters, the velocity of the ship 300 at a Froude number of 0.4 is approximately 11 knots. This velocity is less than the velocity 24 knots for the conventional ship at a Froude number of 0.4. Likewise, for the ship 300 to overcome the hump 100 at a Froude number of 0.8, the ship requires a velocity of approximately 22 knots. Thus, the velocity required for the ship 300 to operate efficiently in a cruising mode at velocities above the hump 100 is far less that the velocity required for the conventional large-waterplane-area ship to operate at the same velocities.

Of course, making each hull portion 301*a–d* shorter than the overall length of the frame 310 of the ship 300 leads to buoyancy problems in that the hull portions 301*a–d* still need to support the weight of the typically massive frame 310. Additional buoyancy may be provided by increasing the width or depth of each hull portion 301*a–d* or by designing one or more submerged pontoons (discussed below with respect to FIG. 5) to be used in conjunction with the frame 310 of the ship i.e., 300.

The distances between hull portions 301*a–d* do not substantially affect the calculation of the Froude number with respect to each hull portion. Furthermore, the arrangement or number of hull portions 301*a–d* also does not substantially affect the calculation of the Froude numbers. The arrangement, spacing, and number of hull portions 301*a–d* may affect other forces such as wind resistance and water friction, but these forces are negligible compared to the force of wave drag Cw at the velocities corresponding to the hump region 100.

In one embodiment, the length of each exclusive hull portion 301*a–d* is varied with respect to the lengths of the other hull portions 301*a–d* to avoid the simultaneous building of wave drag Cw for all the hull portions. Thus, each exclusive hull portion 301*a–d* has a unique length such that no two hull portions 301*a–d* reach the velocity corresponding to its respective Froude number of 0.4 at the same time. In this manner, the ship overcomes several staggered humps 100 corresponding to the hump of each hull portion 301*a–d* one at a time as opposed to all at once.

Because the ship 300 overcomes each hump 100 at a relatively low velocity, it operates efficiently at higher Froude numbers and is not limited in velocity by the effects of increased wave drag CW. This means that when cruising the ship 300 outruns its own wake and is limited in attaining higher velocities primarily by other factors such as wind resistance and water friction.

Figure 4:
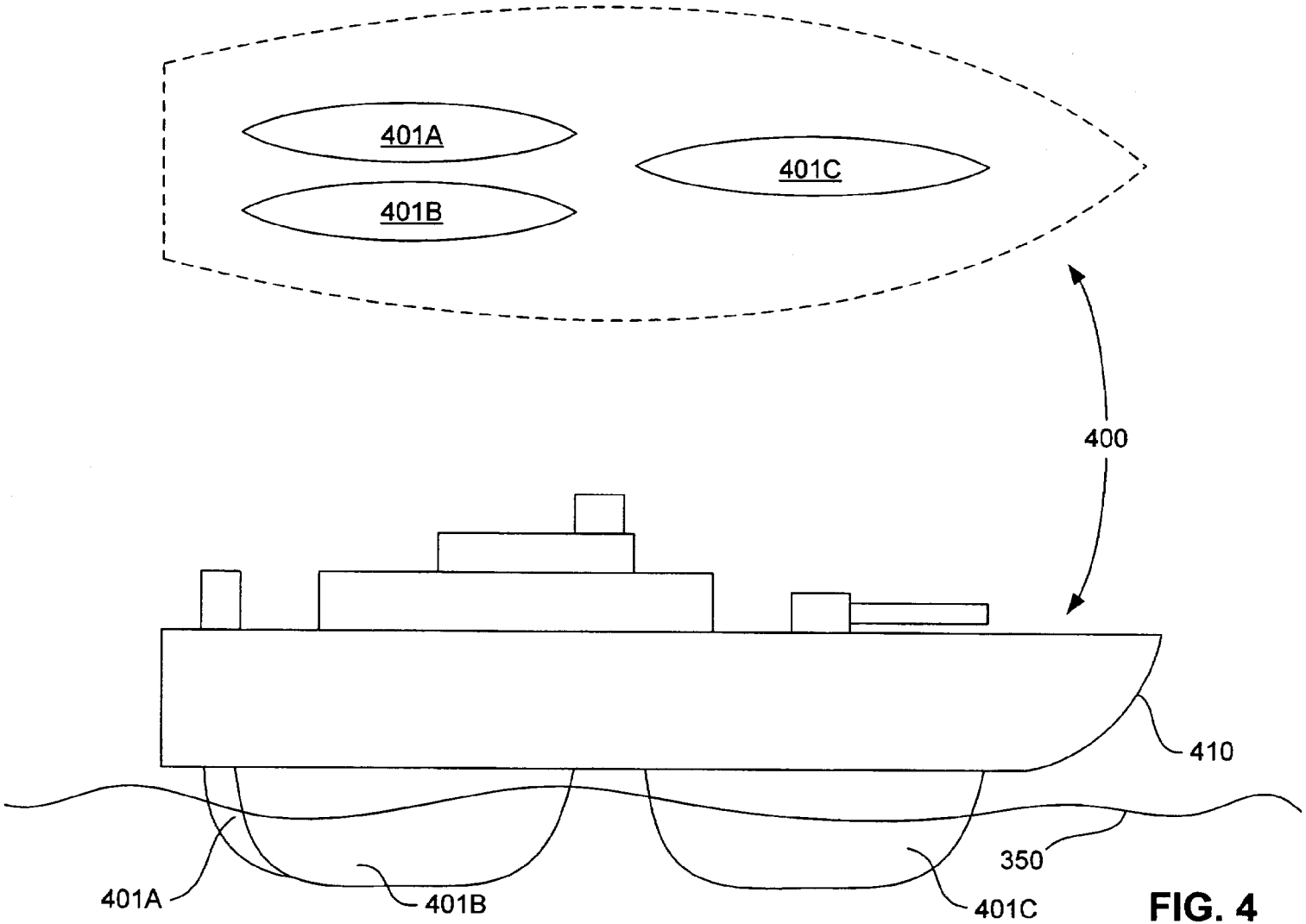
FIG. 4 is a plan view of another ship having a plurality of hull portions according to another embodiment of the invention.

FIG. 4 is another embodiment of a ship 400 having three hull portions 401*a–c* that protrude from a frame 410 of the ship. Again, each hull portion 401*a–c* is analyzed individually with respect to a Froude number calculation, and thus the lengths of individual hull portions determine the velocities of the ship 400 required for the respective hull portions to operate at higher Froude numbers.

Yet other hull designs are contemplated but not shown in drawings. For example, a ship may have several hull portions that form a figure eight pattern or an oval pattern. Various other hull portion patterns are contemplated for efficiency with respect to factors other than wave drag but are not discussed herein for brevity. The number and position of hull portions can be varied to achieve desired operation characteristic of a ship including such hull portions, as will be appreciated by those skilled in the art.

Figure 5:
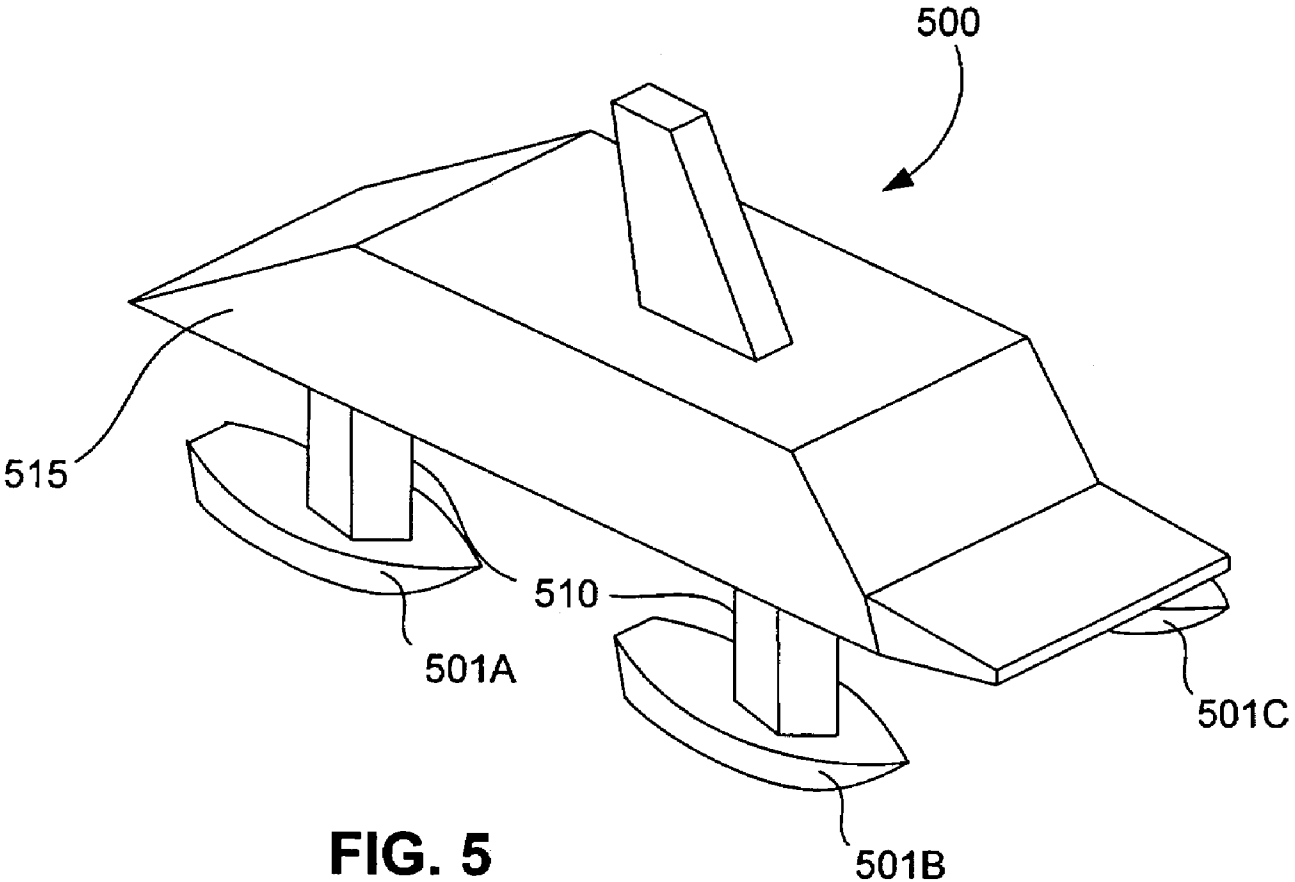
FIG. 5 is an isometric view of another ship having a plurality of exclusive hull portions according to another embodiment of the invention.

FIG. 5 is an isometric view of another ship 500 having three exclusive hull portions 501*a–c* according to another embodiment of the invention. In this embodiment, the overall hull structure of the ship 500 is designed to operate in one of several operational modes. In this manner, the unique advantages of a particular type of hull, such as Catamaran or small-waterplane-area, twin hull (SWATH), can be obtained by adjusting the buoyancy of the ship 500 to suit a particular operational mode.

The ship 500 includes two or more struts 510 that extend down from a main body 515 of the ship 500 and attach to one or more of the hull portions 501*a–c*. The hull portions 501*a–c* collectively have an adjustable buoyancy such that the draft of the ship 500 can be raised or lowered according to operating needs of the ship 500, where the draft the ship is the depth to which the boat is immersed in the water. A conventional ballasting system (not shown) can be used to adjust the buoyancy of the hull portions 501*a–c* and thereby control the overall operational characteristics of the ship 500.

For example, in a first operational mode called a Catamaran mode, the hull portions 501*a–c* are adjusted to their highest buoyancy. Thus, each hull portion 501*a–c* behaves as if it were its own independent hull with respect to wave drag Cw as discussed above. In this mode, the ship 500 efficiently operates in the high Froude area of the respective wave drag curves of each hull portion 501*a–c* because the hump 100 of each hull portion is overcome at a low velocity. Again, the lengths of each hull portion 501*a–c* may be varied to avoid simultaneous wave drag buildup.

In another example, the hull portions 501*a–c* are adjusted to a much lower buoyancy such that the hull portions are completely submerged in water and portions of the struts 510 are also submerged. In this SWATH mode, the hull portions 501*a–c* act primarily as submerged pontoons that provide a majority of the ship's buoyancy. As a result, the ship is essentially transformed from a large-waterplane-area ship to a small-waterplane-area ship to take advantage of SWATH benefits such as improved sea-keeping.

Other operational modes are contemplated and are discussed in greater detail in U.S. patent application Ser. No. 10/712,786, entitled VESSEL WITH A MULTI-MODE HULL, which was filed on Nov. 12, 2003, assigned to the Lockheed Missiles and Space Co. and which is incorporated by reference.

Further, the ship 500 may include any number of struts 510, each strut 510 attached to one or more hull portion 501*a–c*. For example, a ship (not shown) may have a port side strut and a starboard side strut, each strut having six individual hull portions to provide buoyancy. In another example, a ship (also not shown) may have a port side hull portion and a starboard side hull portion, each hull portion attached to the main body of the ship via a plurality of struts extending lengthwise down from the main body. In either example, the struts may be as long as the ship itself or much shorter. Likewise, the hull portions may all have the same lengths or each may have a different length, and may be arranged in various patterns as described above with respect to FIGS. 3 and 4.

The preceding discussion is presented to enable a person skilled in the art to make and use the invention. The general principles described herein may be applied to embodiments and applications other than those detailed above without departing from the spirit and scope of the present invention. The present invention is not intended to be limited to the embodiments shown, but is to be accorded the widest scope consistent with the principles and features disclosed or suggested herein

We claim:

1. A large-waterplane-area ship, comprising:

a hull structure having a plurality of exclusive hull portions protruding from a main body of the hull structure, each hull portion having a Froude number greater than approximately 0.8 during a cruising mode of operation of the ship, eath hull portion being at least partially above a waterline during the cruising mode of operation, wherein each hull portion has a length different from the length of any other hull portion.

2. A ship, comprising:

a main body having a length;

a plurality of struts protruding from the main body; and a plurality of pontoons each coupled to at least one of the plurality of struts, each pontoon being misaligned with the other pontoons along the length, each pontoon having a length shorter than the length of the main body and each pontoon having a buoyancy wherein the combined buoyancy of each pontoon is sufficient to support the main body above a waterline, and wherein each pontoon has a Froude number greater than approximately 0.8 during a cruising mode of operation of the ship.

3. The ship of claim 2 wherein the combined buoyancy of each pontoon is sufficient to support the struts above the water line.

4. The ship of claim 2 wherein each strut is attached to one and only one pontoon.

5. The ship of claim 4 wherein the length of each pontoon is longer than the length of its attached strut.

6. The ship of claim 2 wherein each strut is attached to a plurality of pontoons.

7. The ship of claim 2 wherein the combined buoyancy of the pontoons is adjustable to a level such that the ship operates at one of a plurality of operating modes.

8. The ship of claim 7 wherein the level corresponds to a catamaran operating mode.

9. The ship of claim 7 wherein the level corresponds to a small-waterplane-area twin hull (Swath) operating mode.

10. A method of forming a hull for a ship, comprising:

forming a main body having a length; and directly coupling a plurality of independent buoyant hull portions to the main body, each hull portion having a length that is less than the length of the main body, wherein each hull portion has a different length, and wherein, when the hull travels at a cruising velocity, the combined buoyancy of the hull portions suspends the main body of the hull above the waterline, and each hull portion has a Froude number greater than approximately 0.8.

11. A method of operating a ship, comprising:

forming a main body having a length;

coupling a plurality of independent hull portions to the main body, each hull portion having a length that is less than the length of the main body; and powering the boat to a cruising velocity, wherein at the cruising velocity each of the independent hull portions has a Froude number greater than approximately 0.8, and each of the hull portions is at least partially above a waterline, wherein each hull portion has a different length.

* * * * *